US009011087B2

(12) United States Patent
Mironets et al.

(10) Patent No.: US 9,011,087 B2
(45) Date of Patent: Apr. 21, 2015

(54) HYBRID AIRFOIL FOR A GAS TURBINE ENGINE

(75) Inventors: Sergey Mironets, Norfolk, CT (US); Edward F. Pietraszkiewicz, Southington, CT (US); Alexander Staroselsky, Avon, CT (US); Mark F. Zelesky, Bolton, CT (US)

(73) Assignee: United Technologies Corporation, Hartford, CT (US)

( * ) Notice: Subject to any disclaimer, the term of this patent is extended or adjusted under 35 U.S.C. 154(b) by 486 days.

(21) Appl. No.: 13/429,474

(22) Filed: Mar. 26, 2012

(65) Prior Publication Data

US 2013/0251536 A1 Sep. 26, 2013

(51) Int. Cl.

| | |
|---|---|
| ***F01D 9/02*** | (2006.01) |
| ***F01D 5/14*** | (2006.01) |
| ***F01D 5/28*** | (2006.01) |

(52) U.S. Cl.

CPC *F01D 5/147* (2013.01); *F01D 9/02* (2013.01); *F05D 2240/121* (2013.01); *F05D 2240/122* (2013.01); *F01D 5/28* (2013.01)

(58) Field of Classification Search

CPC F01D 9/02; F05D 2240/121; F05D 2240/122
USPC ..... 415/191, 200, 211.2; 416/241 R, 241 B
See application file for complete search history.

(56) References Cited

U.S. PATENT DOCUMENTS

| | | | | |
|---|---|---|---|---|
| 3,215,511 | A * | 11/1965 | Chisholm et al. | 428/564 |
| 4,247,259 | A | 1/1981 | Saboe et al. | |
| 5,358,379 | A | 10/1994 | Pepperman et al. | |
| 5,388,964 | A | 2/1995 | Ciokajlo et al. | |
| 5,621,968 | A | 4/1997 | Kikkawa et al. | |
| 5,639,531 | A | 6/1997 | Chen et al. | |
| 6,197,146 | B1 | 3/2001 | Sucic et al. | |
| 6,282,786 | B1 | 9/2001 | Evans et al. | |
| 6,451,416 | B1 | 9/2002 | Holowczak et al. | |
| 6,514,046 | B1 * | 2/2003 | Morrison et al. | 416/229 A |
| 6,543,996 | B2 | 4/2003 | Koschier | |
| 6,607,358 | B2 | 8/2003 | Finn et al. | |
| 6,709,230 | B2 | 3/2004 | Morrison et al. | |
| 7,316,539 | B2 | 1/2008 | Campbell | |
| 7,334,997 | B2 * | 2/2008 | Karafillis | 416/224 |
| 7,435,058 | B2 | 10/2008 | Campbell et al. | |
| 7,452,182 | B2 * | 11/2008 | Vance et al. | 415/135 |

(Continued)

FOREIGN PATENT DOCUMENTS

| | | |
|---|---|---|
| JP | 05321602 | 12/1993 |

OTHER PUBLICATIONS

International Search Report and Written Opinion for PCT Application No. PCT/US2013/032918 dated Jan. 24, 2014.

(Continued)

*Primary Examiner* — Ninh H Nguyen
(74) *Attorney, Agent, or Firm* — Carlson, Gaskey & Olds

(57) ABSTRACT

A hybrid airfoil for a gas turbine engine according to an exemplary embodiment of this disclosure can include a leading edge portion, a trailing edge portion, and an intermediate portion between the leading edge portion and the trailing edge portion. The leading edge portion can be made of a first material, the trailing edge portion can be made of a second material, and the intermediate portion can be made of a third material. At least two of the first material, the second material and the third material are different materials.

13 Claims, 3 Drawing Sheets

(56) References Cited

U.S. PATENT DOCUMENTS

| | | | | |
|---|---|---|---|---|
| 7,963,745 | B1 | 6/2011 | Liang | |
| 8,083,489 | B2 | 12/2011 | Viens et al. | |
| 8,197,211 | B1 * | 6/2012 | Liang | 416/97 R |
| 8,366,392 | B1 * | 2/2013 | Liang | 416/97 R |
| 2002/0141870 | A1 * | 10/2002 | Schafrik et al. | 416/97 R |
| 2011/0065973 | A1 | 3/2011 | Fernie et al. | |
| 2013/0170963 | A1 * | 7/2013 | Mironets et al. | 415/173.1 |

OTHER PUBLICATIONS

International Preliminary Report on Patentability for PCT Application No. PCT/US2013/032918, mailed Oct. 9, 2014.

* cited by examiner

HYBRID AIRFOIL FOR A GAS TURBINE ENGINE

BACKGROUND

This disclosure relates to a gas turbine engine, and more particularly to a hybrid airfoil that can be incorporated into a gas turbine engine.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

The compressor section and the turbine section of the gas turbine engine typically include alternating rows of rotating blades and stationary vanes. The rotating blades create or extract energy from the airflow that is communicated through the gas turbine engine, while the vanes direct the airflow to a downstream row of blades. Typically, the blades and vanes are metallic structures that are exposed to relatively high temperatures during gas turbine engine operation. These circumstances may necessitate communicating a cooling airflow through an internal cooling circuit of the blades and vanes.

SUMMARY

A hybrid airfoil for a gas turbine engine according to an exemplary embodiment of this disclosure can include a leading edge portion, a trailing edge portion, and an intermediate portion between the leading edge portion and the trailing edge portion. The leading edge portion can be made of a first material, the trailing edge portion can be made of a second material, and the intermediate portion can be made of a third material. At least two of the first material, the second material and the third material are different materials.

In a further embodiment of the foregoing hybrid airfoil embodiment, the first material and the second material can be metallic materials.

In a further embodiment of either of the foregoing hybrid airfoil embodiments, the third material can include one of a ceramic material and a ceramic matrix composite (CMC) material.

In a further embodiment of any of the foregoing hybrid airfoil embodiments, the first material can be metallic and the second material can be non-metallic.

In a further embodiment of any of the foregoing hybrid airfoil embodiments, a rib can be disposed between the leading edge portion and the intermediate portion.

In a further embodiment of any of the foregoing hybrid airfoil embodiments, a protrusion of one of the rib and the intermediate portion can be received within a pocket of the other of the rib and the intermediate portion.

In a further embodiment of any of the foregoing hybrid airfoil embodiments, an intermediate bonding layer can be disposed between the rib and the intermediate portion.

In a further embodiment of any of the foregoing hybrid airfoil embodiments, a portion between the leading edge portion and the intermediate portion can include a pocket that receives a non-metallic portion, and a connection interface is established between the leading edge portion and the non-metallic portion.

In a further embodiment of any of the foregoing hybrid airfoil embodiments, an intermediate bonding layer can be disposed between the portion and the non-metallic portion.

In a further embodiment of any of the foregoing hybrid airfoil embodiments, the airfoil can be a turbine vane.

A hybrid airfoil for a gas turbine engine according to another exemplary embodiment of this disclosure can include a metallic portion, a non-metallic portion, and an intermediate bonding layer disposed between the metallic portion and the non-metallic portion.

In a further embodiment of the foregoing hybrid airfoil embodiment, the intermediate bonding layer can include a gradient between the metallic portion and the non-metallic portion.

In a further embodiment of either of the foregoing hybrid airfoil embodiments, the intermediate bonding layer can include a variation in composition and structure gradually over volume between the metallic portion and the non-metallic portion.

In a further embodiment of any of the foregoing hybrid airfoil embodiments, the intermediate bonding layer can include a functionally graded material (FGM).

In a further embodiment of any of the foregoing hybrid airfoil embodiments, the non-metallic portion can include one of a ceramic material and a ceramic matrix composite (CMC) material and the metallic portion can include one of a cobalt based super alloy material and a nickel based super alloy material.

In a further embodiment of any of the foregoing hybrid airfoil embodiments, the intermediate bonding layer can be mechanically trapped between the metallic portion and the non-metallic portion.

A method of providing a hybrid airfoil for a gas turbine engine according to another exemplary embodiment of this disclosure can include providing a metallic leading edge portion of the hybrid airfoil, providing a metallic trailing edge portion of the hybrid airfoil, and disposing a non-metallic intermediate portion between the leading edge portion and the trailing edge portion.

In a further embodiment of the foregoing method, the intermediate portion can include one of a ceramic material and a CMC.

In a further embodiment of either of the foregoing methods, a rib can be positioned between the leading edge portion and the intermediate portion.

In a further embodiment of any of the foregoing methods, a protrusion can be inserted within a pocket of one of the rib and the intermediate portion.

The various features and advantages of this disclosure will become apparent to those skilled in the art from the following detailed description. The drawings that accompany the detailed description can be briefly described as follows.

DETAILED DESCRIPTION

Figure 1:
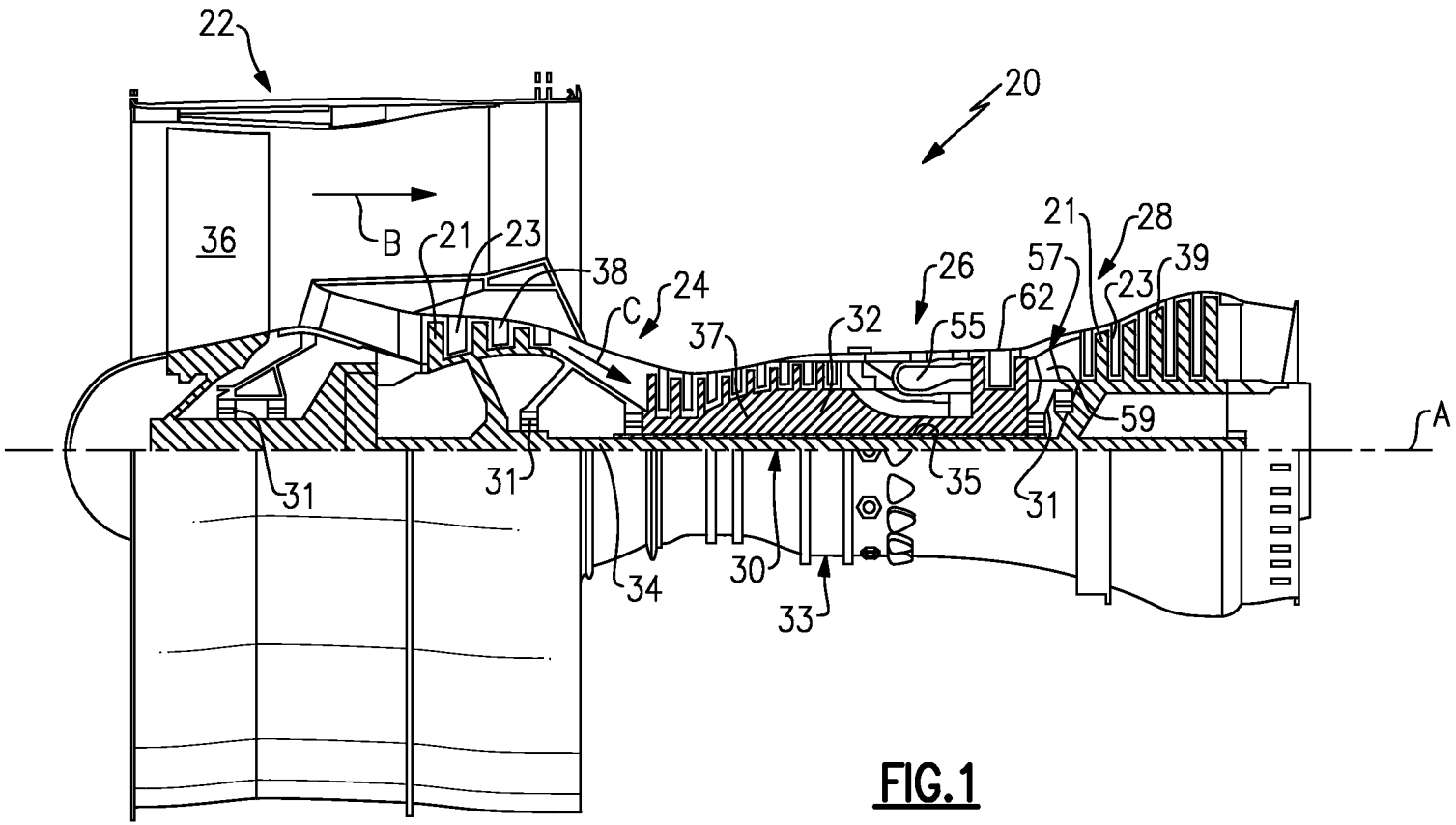
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems or features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of turbine engines, including but not limited to three-spool engine architectures.

The gas turbine engine 20 generally includes a low speed spool 30 and a high speed spool 32 mounted for rotation about an engine centerline longitudinal axis A relative to an engine static structure 33 via several bearing structures 31. It should be understood that various bearing structures 31 at various locations may alternatively or additionally be provided.

The low speed spool 30 generally includes an inner shaft 34 that interconnects a fan 36, a low pressure compressor 38 and a low pressure turbine 39. The high speed spool 32 includes an outer shaft 35 that interconnects a high pressure compressor 37 and a high pressure turbine 62. In this example, the inner shaft 34 and the outer shaft 35 are supported at various axial locations by bearing structures 31 positioned within the engine static structure 33.

A combustor 55 is arranged between the high pressure compressor 37 and the high pressure turbine 62. A mid-turbine frame 57 of the engine static structure 33 is arranged generally between the high pressure turbine 62 and the low pressure turbine 39. The mid-turbine frame 57 can support one or more bearing structures 31 in the turbine section 28. The inner shaft 34 and the outer shaft 35 are concentric and rotate via the bearing structures 31 about the engine centerline longitudinal axis A, which is collinear with their longitudinal axes.

The core airflow is compressed by the low pressure compressor 38 and the high pressure compressor 37, is mixed with fuel and burned in the combustor 55, and is then expanded over the high pressure turbine 62 and the low pressure turbine 39. The mid-turbine frame 57 includes airfoils 59 which are in the core airflow path. The high pressure turbine 62 and the low pressure turbine 39 rotationally drive the respective low speed spool 30 and the high speed spool 32 in response to the expansion.

The compressor section 24 and the turbine section 28 can each include alternating rows of rotor assemblies 21 and vane assemblies 23. The rotor assemblies 21 include a plurality of rotating blades, and each vane assembly 23 includes a plurality of vanes. The blades of the rotor assemblies 21 create or extract energy (in the form of pressure) from the airflow that is communicated through the gas turbine engine 20. The vanes of the vane assemblies 23 direct airflow to the blades of the rotor assemblies 21 to either add or extract energy.

Figure 2:
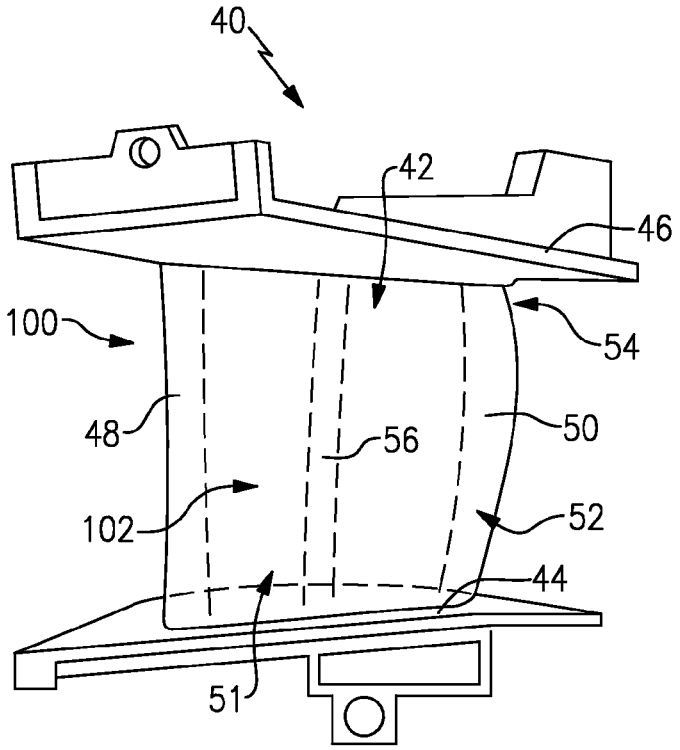
FIG. 2 illustrates a hybrid airfoil that can be incorporated into a gas turbine engine.

FIG. 2 illustrates a hybrid airfoil 40 that can be incorporated into a gas turbine engine, such as the gas turbine engine 20 of FIG. 1. In this example, the hybrid airfoil 40 is a vane of a vane assembly of either the compressor section 24 or the turbine section 28. However, the teachings of this disclosure are not limited to vane-type airfoils and could extend to other airfoils, including but not limited to, the airfoils of a gas turbine engine mid-turbine frame. This disclosure could also extend to non-airfoil hardware including stationary structures of the gas turbine engine 20.

The hybrid airfoil 40 of this exemplary embodiment includes at least one metallic portion 100 and at least one non-metallic portion 102. Therefore, as used in this disclosure, the term "hybrid" is intended to denote a structure that includes portions made from at least two different materials, such as a metallic portion and a non-metallic portion.

In the exemplary embodiment, the hybrid airfoil 40 includes a hybrid airfoil body 42 that extends between an inner platform 44 (on an inner diameter side) and an outer platform 46 (on an outer diameter side). The hybrid airfoil body 42 includes a leading edge portion 48, a trailing edge portion 50, an intermediate portion 51 disposed between the leading edge portion 48 and the trailing edge portion 50, a pressure side 52 and a suction side 54. In one non-limiting embodiment, the leading edge portion 48 and the trailing edge portion 50 may establish the metallic portions 100 of the hybrid airfoil body 42, while the intermediate portion 51 may establish a non-metallic portion 102 of the hybrid airfoil body 42.

The hybrid airfoil body 42 can also include a rib 56 disposed between the leading edge portion 48 and the intermediate portion 51. The rib 56 extends between the inner platform 44 and the outer platform 46 and can extend across an entire distance between the pressure side 52 and the suction side 54 of the hybrid airfoil body 42 (See FIG. 3). In the exemplary embodiment, the rib 56 is a metallic structure that can add structural rigidity to the hybrid airfoil 40 and serve as an additional tie between the inner platform 44 and the outer platform 46.

Figure 3:
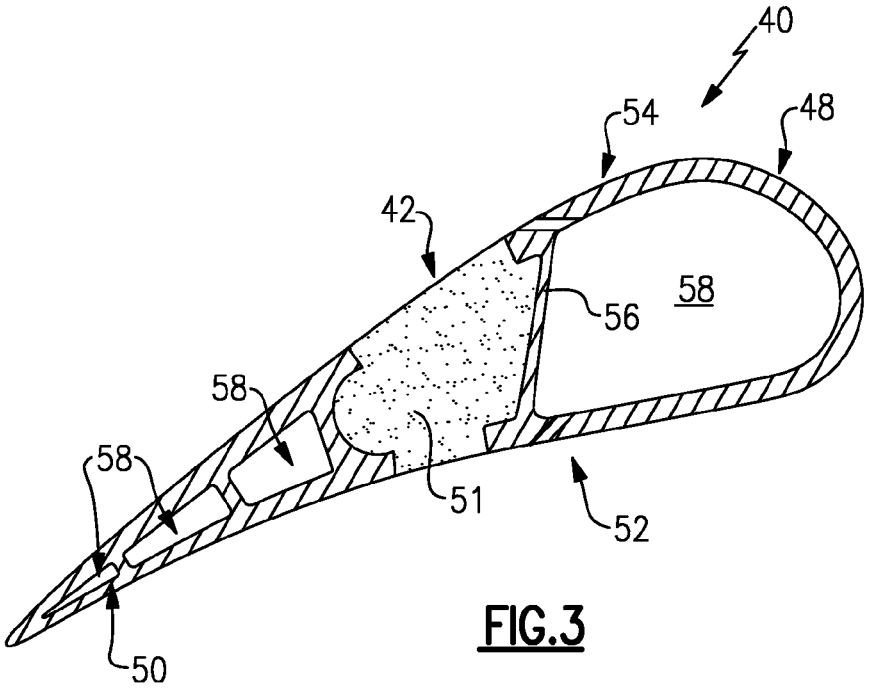
FIG. 3 illustrates a cross-sectional view of the hybrid airfoil of FIG. 2.

FIG. 3 illustrates a cross-sectional view of a hybrid airfoil body 42 of the hybrid airfoil 40. The hybrid airfoil body 42 includes the leading edge portion 48, the trailing edge portion 50, and the intermediate portion 51 disposed between the leading edge portion 48 and the trailing edge portion 50. The leading edge portion 48 can be made of a first material, the trailing edge portion 50 can be made of a second material and the intermediate portion 51 can be made of a third material. The first material, the second material and the third material are at least two different materials, in one example.

In this exemplary embodiment, the first material and the second material are metallic materials and the third material is a non-metallic material. Example metallic materials that can be used to manufacture the leading edge portion 48 and the trailing edge portion 50 include, but are not limited to, nickel based super alloys and cobalt based super alloys. The second material could also include a non-metallic material such as a monolithic ceramic. The third material can include a non-metallic material such as a ceramic material. In another example, the intermediate portion 51 is made of a ceramic matrix composite (CMC). Non-limiting examples of materials that can be used to provide the intermediate portion 51 include oxides such as silica, alumina, zirconia, yttria, and titania, non-oxides such as carbides, borides, nitrides, and silicides, any combination of oxides and non-oxides, composites including particulate or whisker reinforced matrices, and cermets. These materials are not intended to be limiting on this disclosure as other materials may be suitable for use as the non-metallic portion of the hybrid airfoil 40.

Each of the leading edge portion 48 and the trailing edge portion 50 can include one or more cooling passages 58 that radially extend through the hybrid airfoil body 42 (i.e., between the inner platform 44 and the outer platform 46). The cooling passages 58 establish an internal circuit for the communication of cooling airflow, such as a bleed airflow, that can be communicated through the hybrid airfoil body 42 to cool the hybrid airfoil 40. In the illustrated embodiment, the intermediate portion 51 does not include a cooling passage because the non-metallic nature of the intermediate portion 51 may not require dedicated cooling. However, if desired, and depending upon certain design and operability characteristics, one or more cooling passages could be disposed through the intermediate portion 51 to provide additional cooling.

Figure 4:
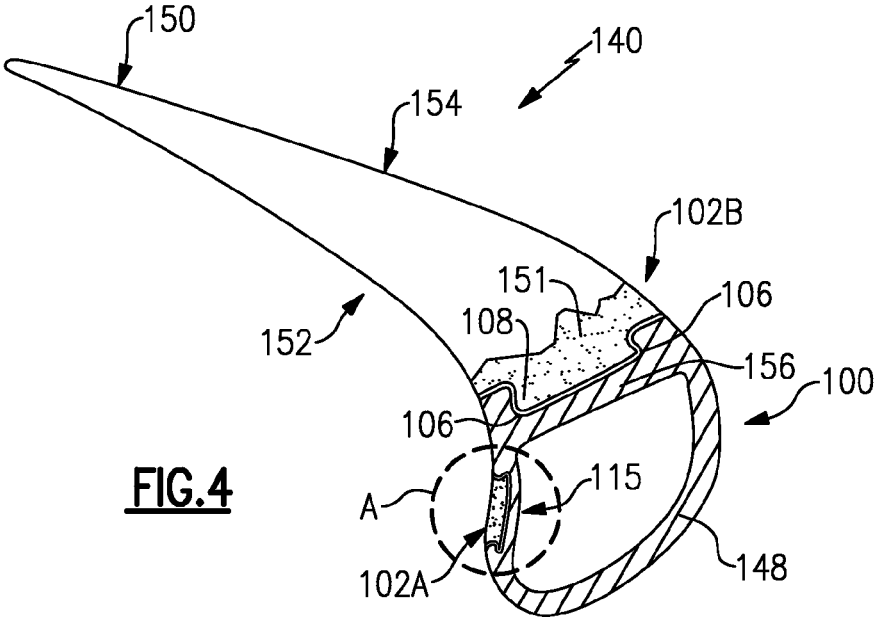
FIG. 4 illustrates another hybrid airfoil that can be incorporated into a gas turbine engine.

FIG. 4 illustrates another example hybrid airfoil 140. In this disclosure, like reference numerals signify like features, and reference numerals identified in multiples of 100 signify slightly modified features. Moreover, select features from one example embodiment may be combined with select features from other example embodiments within the scope of this disclosure.

The hybrid airfoil 140 includes at least one metallic portion 100 (i.e., a cobalt or nickel based super alloy) and one or more non-metallic portions 102 (i.e., a ceramic or CMC). This exemplary embodiment illustrates two non-metallic portions 102A, 102B, although it should be understood that the hybrid airfoil 140 could include any number of non-metallic portions 102 to reduce weight and dedicated cooling requirements of the hybrid airfoil 140. For example, the hybrid airfoil 140 could include two different non-metallic regions with the intermediate portion 151 being a CMC or a ceramic material and the trailing edge portion 150 being made of a monolithic ceramic. In this exemplary embodiment, the metallic portion 100 is a leading edge portion 148 of the hybrid airfoil 140, the non-metallic portion 102A is a portion 115 of the hybrid airfoil 140 between the leading edge portion 148 and a rib 156, and the non-metallic portion 102B is an intermediate portion 151 of the hybrid airfoil 140. The portion 115 can be disposed either on the pressure side 152 of the hybrid airfoil 140 (as shown in FIG. 4), the suction side 154 of the hybrid airfoil 140, or both. In this example, the portion 115 is positioned on the pressure side 152, although this disclosure is not limited to this particular embodiment.

Figure 5:
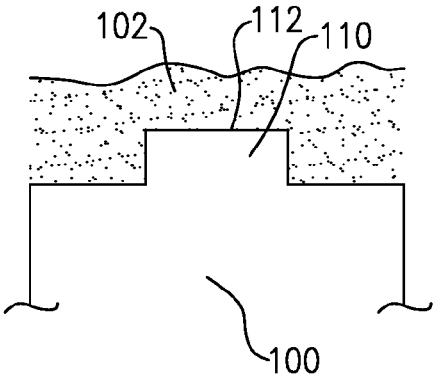
FIG. 5 illustrates a portion of yet another hybrid airfoil.

The rib 156 of this exemplary embodiment is metallic and includes a pocket 106 that faces toward the intermediate portion 151 (i.e., the pocket 106 faces in a direction away from the leading edge portion 148). A protruding portion 108 of the intermediate portion 151 is received within the pocket 106 to connect the non-metallic portion 102B to the metallic portion 100 of the hybrid airfoil 140. An opposite configuration is also contemplated in which a protruding portion 110 of the metallic portion 100 is received within a pocket 112 of the non-metallic portion 102 to attach these components (See FIG. 5). In addition, other connections between metallic and non-metallic portions can be provided on the hybrid airfoil 140, such as between the intermediate portion 151 and a trailing edge portion 150.

Figure 6:
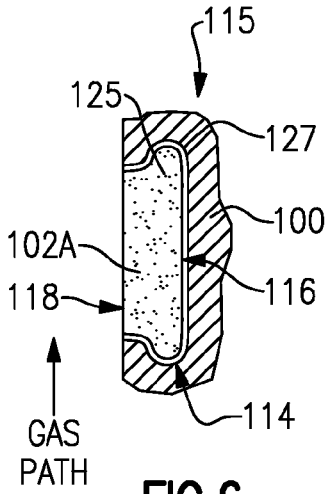
FIG. 6 illustrates a blow up of a portion of the hybrid airfoil of FIG. 4.

FIG. 6 illustrates additional features of the portion 115 of the hybrid airfoil 140, which establishes a connection interface 114 between a metallic portion 100 and a non-metallic portion 102A of a hybrid airfoil 140. In this example, the connection interface 114 is located at location A of FIG. 4. At location A, an outer surface 118 of the non-metallic portion 102A faces a gas path that is communicated across the hybrid airfoil 140. In this exemplary embodiment, a protrusion 125 of the non-metallic portion 102A is received in a pocket 127 of the metallic portion 100.

An intermediate bonding layer 116 can be disposed between the metallic portion 100 and the non-metallic portion 102A of the hybrid airfoil 140. The intermediate bonding layer 116 provides a transitional interface between the metallic portion 100 and the non-metallic portion 102 and provides a buffer between the 100% metal alloy of the metallic portion 100 and the 100% non-metallic portion 102 to accommodate any mismatch in mechanical properties and thermal expansion of the metallic portion 100 as compared to the non-metallic portion 102. Although not depicted as such in FIG. 4, an intermediate bonding layer could also be disposed between the metallic rib 156 and the non-metallic portion 102B. The intermediate bonding layer 116 could also be mechanically trapped between the metallic portion 100 and the non-metallic portion 102A (i.e., the intermediate bonding layer 116 is not necessarily bonded to the various surfaces).

In one non-limiting embodiment, a gradient of the intermediate bonding layer 116 is a multi-graded layer. In other words, the gradient of the intermediate bonding layer 116 transitions across its thickness from 100% metal alloy to 100% non-metal material (from right to left in FIG. 6). It should be appreciated that the transition may be linear or non-linear as required. The required gradient may be determined based on design experimentation or testing to achieve the desired transition.

The intermediate bonding layer 116 may, for example, be a nanostructured functionally graded material (FGM). The FGM includes a variation and composition in structure gradually over volume, resulting in corresponding changes in the properties of the material for specific function and applications. Various approaches based on the bulk (particulate processing), preformed processing, layer processing and melt processing can be used to fabricate the FGM, including but not limited to, electron beam powder metallurgy technology, vapor deposition techniques, electromechanical deposition, electro discharge compaction, plasma-activated sintering, shock consolidation, hot isostatic pressing, Sulzer high vacuum plasma spray, etc.

Although the different examples have specific components shown in the illustrations, embodiments of this disclosure are not limited to those particular combinations. It is possible to use some of the components or features from one of the examples in combination with features or components from another one of the examples.

Furthermore, the foregoing description shall be interpretative as illustrated and not in any limiting sense. A worker of ordinary skill in the art would understand that certain modifications could come within the scope of this disclosure. For these reasons, the following claims should be studied to determine the true scope and content of this disclosure.

What is claimed is:

1. A hybrid airfoil for a gas turbine engine, comprising:

a leading edge portion;

a trailing edge portion;

an intermediate portion between said leading edge portion and said trailing edge portion, wherein said intermediate portion is a solid section of the hybrid airfoil that excludes any radial passages, and wherein said leading edge portion is made of a first material, said trailing edge portion is made of a second material, and said intermediate portion is made of a third material, and at least two of said first material, said second material and said third material are different materials;

a rib disposed between said leading edge portion and said intermediate portion, wherein a protrusion of one of said rib and said intermediate portion is received within a pocket of the other of said rib and said intermediate portion; and an intermediate bonding layer between said rib and said intermediate portion.

2. The hybrid airfoil as recited in claim 1, wherein said first material and said second material are metallic materials.

3. The hybrid airfoil as recited in claim 1, wherein said third material is one of a ceramic material and a ceramic matrix composite (CMC) material.

4. The hybrid airfoil as recited in claim 1, wherein said first material is a metallic material and said second material is a non-metallic material.

5. The hybrid airfoil as recited in claim 1, wherein said airfoil is a turbine vane.

6. A hybrid airfoil for a gas turbine engine, comprising:

a leading edge portion;

a trailing edge portion;

an intermediate portion between said leading edge portion and said trailing edge portion, wherein said leading edge portion is made of a first material, said trailing edge portion is made of a second material, and said intermediate portion is made of a third material, and at least two of said first material, said second material and said third material are different materials; and wherein a portion between said leading edge portion and said intermediate portion includes a pocket that receives a non-metallic portion, wherein a connection interface is established between said leading edge portion and said non-metallic portion.

7. The hybrid airfoil as recited in claim 6, comprising an intermediate bonding layer disposed between said portion and said non-metallic portion.

8. A hybrid airfoil for a gas turbine engine, comprising:

a hybrid airfoil body including:

a metallic portion;

a non-metallic portion; and an intermediate bonding layer disposed between said metallic portion and said non-metallic portion;

wherein said intermediate bonding layer includes a variation in composition and structure gradually over volume between said metallic portion and said non-metallic portion.

9. The hybrid airfoil as recited in claim 8, wherein said intermediate bonding layer includes a gradient between said metallic portion and said non-metallic portion.

10. The hybrid airfoil as recited in claim 8, wherein said non-metallic portion includes one of a ceramic material and a ceramic matrix composite (CMC) material and said metallic portion includes one of a cobalt based super alloy material and a nickel based super alloy material.

11. A hybrid airfoil for a gas turbine engine, comprising:

a hybrid airfoil body including:

a metallic portion;

a non-metallic portion; and an intermediate bonding layer disposed between said metallic portion and said non-metallic portion;

wherein said intermediate bonding layer includes a functionally graded material (FGM).

12. A hybrid airfoil for a gas turbine engine, comprising:

a hybrid airfoil body including:

a metallic portion;

a non-metallic portion; and an intermediate bonding layer disposed between said metallic portion and said non-metallic portion;

wherein said intermediate bonding layer is mechanically trapped between said metallic portion and said non-metallic portion.

13. A hybrid airfoil for a gas turbine engine, comprising:

a hybrid airfoil body including:

a metallic portion;

a non-metallic portion; and an intermediate bonding layer disposed between said metallic portion said non-metallic portion;

wherein said non-metallic portion is received within a pocket of said metallic portion.

* * * * *